US005524938A

United States Patent [19]

Halder

[11] Patent Number: 5,524,938

[45] Date of Patent: Jun. 11, 1996

[54] TUBE CONNECTION FOR A WATER BOX OF A MOTOR VEHICLE HEAT EXCHANGER

[75] Inventor: Prasanta Halder, Ditzingen, Germany

[73] Assignee: Behr GmbH & Co., Stuttgart, Germany

[21] Appl. No.: 378,953

[22] Filed: Jan. 27, 1995

[30] Foreign Application Priority Data

Feb. 4, 1994 [DE] Germany ..... 44 03 402.4

[51] Int. Cl.[6] ..... F16L 5/02

[52] U.S. Cl. ..... 285/201; 285/158; 285/287; 285/305; 285/368; 285/906; 228/173.1; 228/178; 228/25 A

[58] Field of Search ..... 285/287, 906, 285/201, 189, 158, 305, 368; 228/173.1, 254, 178

[56] References Cited

U.S. PATENT DOCUMENTS

| | | | |
|---|---|---|---|
| 1,280,311 | 10/1918 | Scheeland | 285/287 X |
| 1,432,850 | 10/1922 | Halsten | 285/201 X |
| 1,758,869 | 5/1930 | Tragesa et al. | 285/287 X |
| 1,901,820 | 3/1933 | Parker | 285/287 X |
| 1,931,311 | 10/1933 | Young | 285/201 |
| 2,183,271 | 12/1939 | Wendel | 285/287 |
| 3,680,200 | 8/1972 | Terrill et al. | 285/287 X |
| 3,711,628 | 1/1973 | Hansson | 285/287 X |
| 4,738,306 | 4/1988 | Tamba et al. . | |
| 5,338,034 | 10/1994 | Nishishita et al. | 285/287 X |

FOREIGN PATENT DOCUMENTS

| | | |
|---|---|---|
| 0303456A1 | 2/1989 | European Pat. Off. . |
| 0384612A2 | 8/1990 | European Pat. Off. . |
| 2019743 | 11/1970 | Germany . |
| 3141580A1 | 8/1982 | Germany . |
| 3517488C2 | 11/1986 | Germany . |
| 4130517A1 | 3/1993 | Germany . |
| 931504 | 6/1982 | Russian Federation . |

OTHER PUBLICATIONS

German Search Report, Jun. 30, 1994, Germany.

*Primary Examiner*—Dave W. Arola
*Attorney, Agent, or Firm*—Evenson Mc Keown Edwards & Lenahan

[57] ABSTRACT

A tube connection for a water box of a motor vehicle heat exchanger is disclosed. A connecting sleeve is provided which is a component which is separate from the water box and is provided with a connecting area which can be inserted into a corresponding opening of the water box.

14 Claims, 4 Drawing Sheets

TUBE CONNECTION FOR A WATER BOX OF A MOTOR VEHICLE HEAT EXCHANGER

BACKGROUND AND SUMMARY OF THE INVENTION

This invention relates to a tube connection for a water box of a motor vehicle heat exchanger comprising a connecting sleeve with which a tube end of a tube can be tightly connected which is used for carrying heat exchange liquid.

From the German Patent Document DE 35 17 488 C2, a water box for a motor vehicle heat exchanger is known which comprises a tube connection. For this purpose, a connecting sleeve, which forms one piece with the water box, is molded onto the water box, a tube end of a tube which is used for carrying the heat exchange liquid being axially insertable into the opening of the connecting sleeve. In the connecting sleeve, this tube is held by means of a clamp which is bent in a U-shape and can be inserted in a radial manner. The water box, including the connecting sleeve, are made of a plastic material. However, plastic water boxes are not suitable for use at higher system pressures.

It is an object of the invention to provide a tube connection of the initially mentioned type which has improved usage possibilities and which is suitable for use in motor vehicle heat exchange systems with relatively high system pressures.

This object is achieved according to preferred embodiments of the invention in that the connecting sleeve is a connecting component which is separate from the water box and which is provided with a connecting area which can be inserted into a corresponding opening of the water box. As a result, it is possible to mount the connecting sleeve on easily accessible locations of the water box. The manufacturing of the water box and of the connecting sleeve is significantly simplified as a result of the separation of the connecting sleeve and the water box. As the result of the separation of the connecting sleeve and its use as a connecting component, it is also possible to use the tube connection as a connecting device between two tubes.

As a further development of the invention, at least the connection area of the connecting sleeve is made from a solderable material, particularly a metal. As a result, it is possible to also solder the connecting sleeve during the manufacturing of the heat exchanger.

It is advantageous to carry out the soldering of the whole heat exchanger, that is, of the water boxes, the finned tube block and the connecting sleeve, in one operation if the water boxes of the heat exchanger were made of metal sheets in the deep-drawing process.

In a further development of the invention, the connecting sleeve is produced in one piece in the deep-drawing process. This ensures a cost-effective and simple manufacturing of the connecting sleeve.

In a further development of the invention, the connecting area of the connecting sleeve is coated with a solderable material. As a result, the connecting sleeve can be soldered in its connecting area, with which it is connected with the corresponding component in a tight manner.

In a further development of the invention, the connecting component is produced from an aluminum material. This is advantageous for high system pressures if the water boxes are also made of an aluminum material so that identical materials can be connected in a simple manner.

Other objects, advantages and novel features of the present invention will become apparent from the following detailed description of the invention when considered in conjunction with the accompanying drawings.

BRIEF DESCRIPTION OF THE DRAWINGS

FIG. 5 is a view of another embodiment of a tube connection which is similar to FIG. 2 and in the case of which a tube end, which is fitted axially into the connecting sleeve, is held in a tight manner by means of a lug which can be screwed on.

DETAILED DESCRIPTION OF THE DRAWINGS

Figure 1:
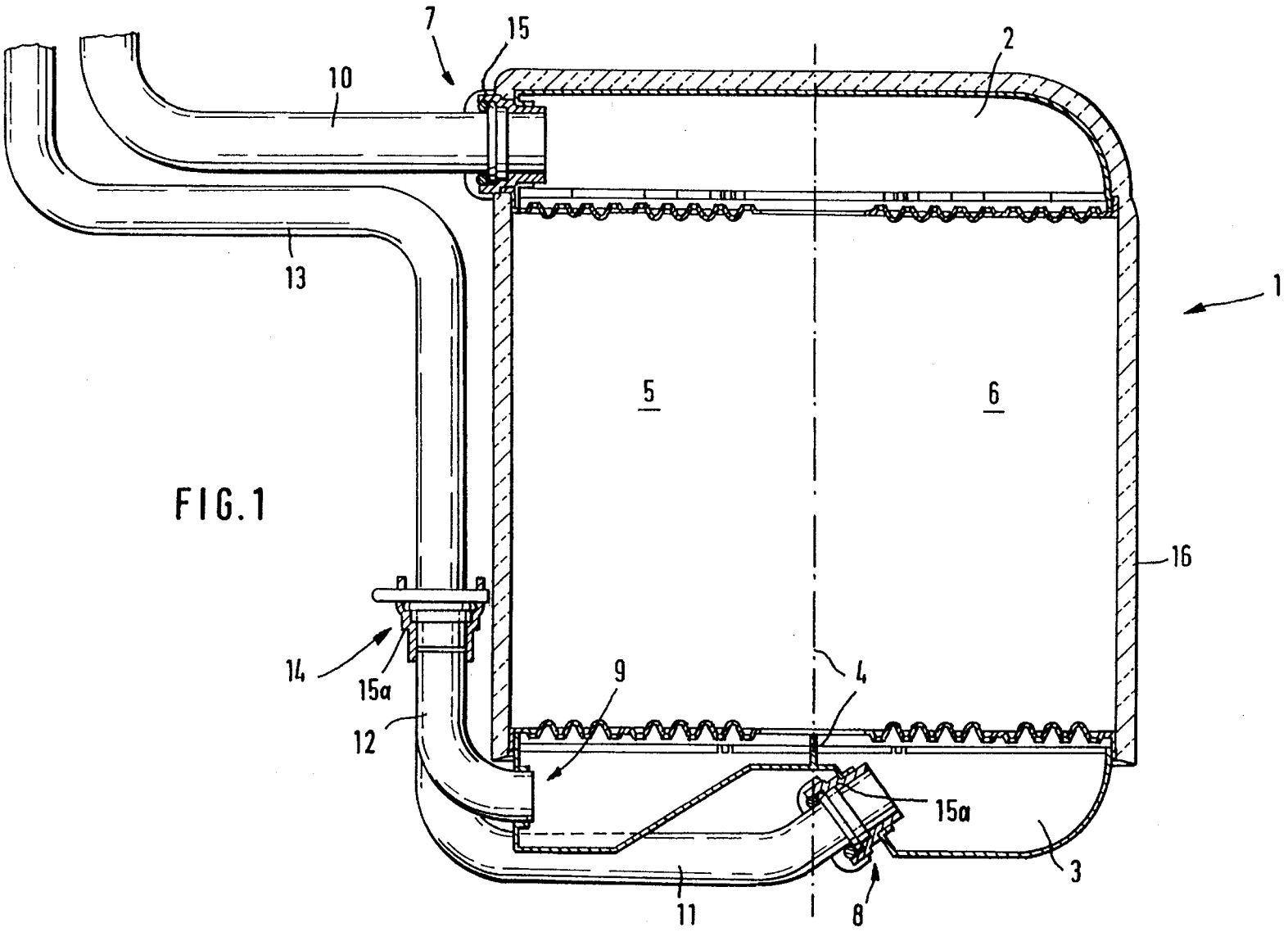
FIG. 1 is a sectional view of a motor vehicle heat exchanger in the form of a heater comprising an upper and a lower water box, in which case one embodiment of the tube connection according to the invention respectively is provided for each water box.

In FIG. 1, a heat exchanger for a motor vehicle is a heater 1 for a passenger car. The heater 1 has an upper water box 2 as well as a lower water box 3 which is divided into two parts, a finned tube block divided into two halves 5 and 6 extending between the two water boxes. The finned tube block of the heater 1 is therefore divided into two halves 5, 6 through which heat exchange liquid can flow in a mutually independent manner.

The heater 1 is therefore particularly suitable for passenger cars in which the heating temperature in the interior can in each case be adjusted separately for the driver side and for the front passenger side.

In order to achieve the separate flowing-through of the heat exchange liquid, a tube connection 7 for a tube 10 serving as a feeding tube is provided on the upper water box 2. On the lower water box 3, a tube connection 8, 9 is provided which serves as a discharge tube for each half 5, 6 respectively of the finned tube block. A tube 11 connects to the tube connection 8 for the right half 6 of the finned tube block, and a tube 12 connects to the tube connection 9 for the left half 5 of the finned tube block. The heater 1 therefore has one inlet and two mutually independent outlets.

The tube 12 is only a tube sleeve to which another tube 13 connects by means of a tube connection 14. In the representation of FIG. 1, the tube 11 is arranged in an invisible manner behind the tube 12 or the tube 13.

In the embodiment shown, the tubes 11, 13 as well as the tube sleeve 12 for the tube 13 have a diameter of 15 mm. In contrast, the tube 10 connecting to the tube connection 7 has a larger diameter of 18 mm in order to create suitable flow conditions in the flow circulation because two tubes 11, 12 connect to the lower water box 3 and only one tube 10 connects to the upper water box.

In another embodiment of the invention, the two tubes 11; 12, 13 are provided as the feeding tubes and the tube 10 with the correspondingly enlarged diameter is provided as the return flow tube. The exterior wall of the heater 1 is surrounded by an insulation 16 which is known per se.

In the embodiment shown, the two water boxes 2, 3 are made from an aluminum material in the deep drawing process and are suitable for use in relatively high system pressures.

Figure 2:
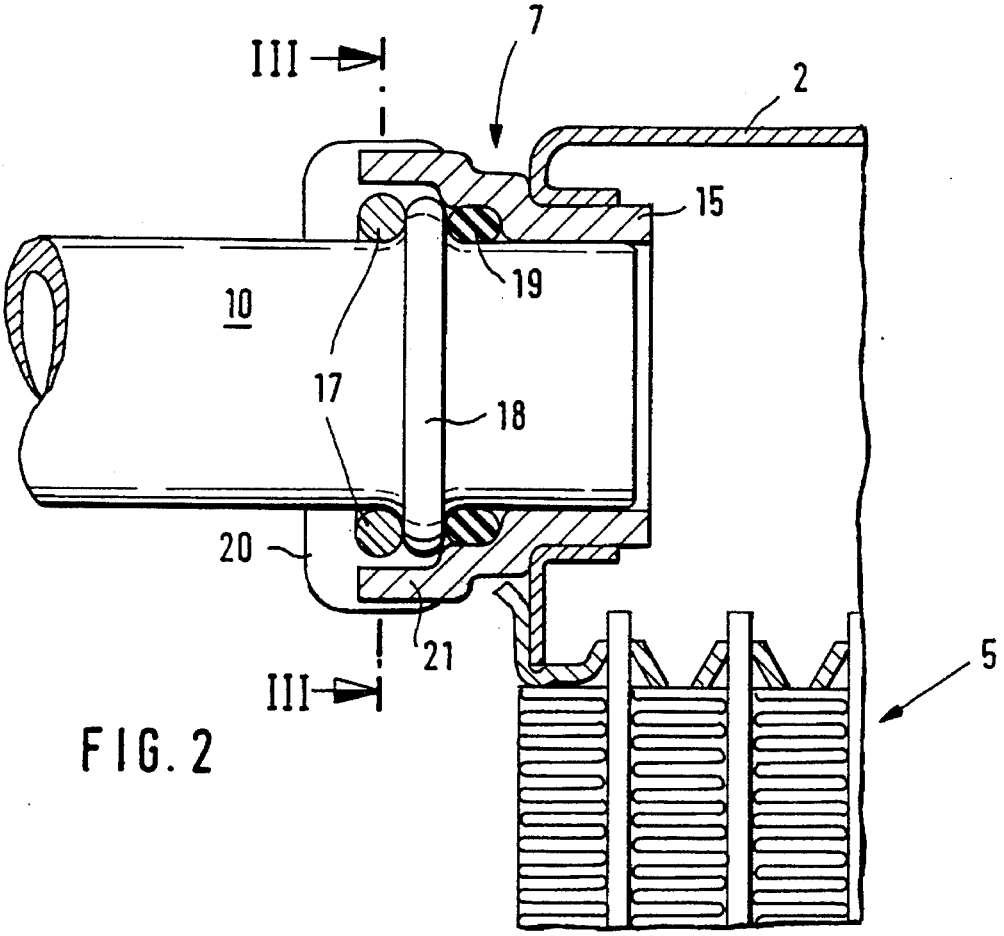
FIG. 2 is an enlarged representation of a cut-out of the upper water box of the heater according to FIG. 1 at the level of the tube connection, in the case of which, for reasons of clarity, the insulation of the heater is not shown.
Figure 3:
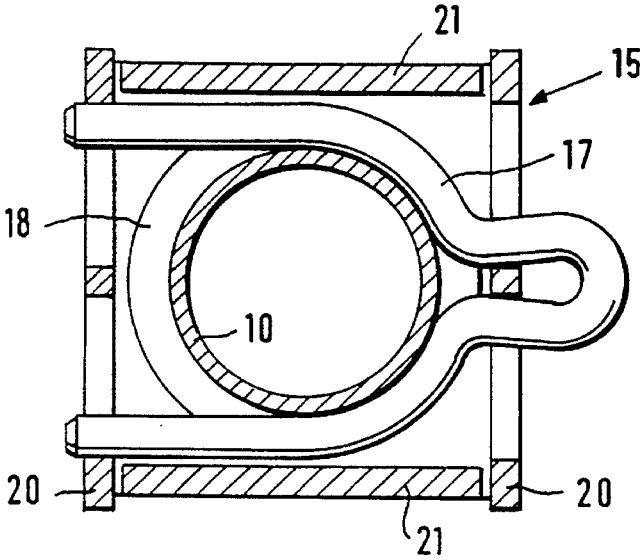
FIG. 3 is a sectional view of a connecting sleeve of the tube connection according to FIG. 2 along the intersection line III—III in FIG. 2.

The tube connections 7, 8, 14 are each provided with a connecting sleeve 15, 15*a* which represents a one-piece connecting component which is separated from the respective water box 2, 3 or the tube socket 12. The connecting sleeves 15*a* are provided in the area of the pipe connections 8, 14 and are adapted to the diameters of the tubes 11, 12, 13. In contrast, the connecting sleeves 15 have slightly larger dimensions and are adapted to the diameters of the tube 10. With the exception of their different sizes, however, the connecting sleeves 15, 15*a* are identical. Connecting sleeve 15 will be described in the following by means of FIGS. 2 and 3.

In order to be able to use the connecting sleeve 15 in the upper water box 2, the wall of the upper water box 2 has a circular opening which, for the purpose of a reinforcement, is provided with an inwardly bent, surrounding edge. The opening in the area of the tube connection 8 in the lower water box 3 has an analogous construction so that the above-mentioned detailed description of the tube connection 7 to the upper water box 2 can correspondingly be applied to the lower water box 3.

The connecting sleeve 15 is made of the same material as the water box 7, specifically of an aluminum material, and has a tube-shaped connecting area whose outside diameter is adapted to the inside diameter of the opening in the upper water box 2 in such a manner that it is possible to slide the connecting area into the opening.

The connecting area is adjoined by a cylindrical area of a larger diameter which is expanded in a step-shaped manner and which is used as a stop collar device for an exact positioning of the connecting sleeve 15 in the opening of the water box 2. For this reason, it is possible to insert the connecting sleeve 15 so far into the opening of the water box 2 until the stop collar device comes to rest on the exterior side of the edge of the opening of the water box 2.

The front end, which is situated opposite the connecting area of the connecting sleeve 15, represents a square receiving opening which is bounded by four side walls 20, 21. In this case, the respective opposite side walls 21, 20 are identical in their heights, widths and shapes. The side walls 20 are higher and wider than the side walls 21 and each have slots for the passing-through of a securing clamp 17. The securing clamp 17 reaches behind a collar 18 of the tube end of tube 10 axially inserted into the connecting sleeve 15, which collar 18 is formed by upsetting. The outside diameter of the tube 10 corresponds approximately to the inside diameter of the connecting area of the connecting sleeve 15.

In the area of the interior wall of the stepped stop collar device of the connecting sleeve 15, a surrounding sealing device 19 is provided which, when the tube end is slid in, is compressed by the collar 18. In order to hold the tube end of tube 10 tightly in the connecting sleeve 15, the U-shaped securing clamp 17, which is pushed through the slots of the side walls 20, reaches behind the collar 18.

The securing of tube 10 in the connecting sleeve 15 corresponds essentially to the tube connection according to German Patent Document DE 35 17 488 C2, to which reference is made in this respect.

The connecting sleeve 15 is produced in one piece in the deep drawing process, whereby the connecting area and the stop collar device are created. After the slots are punched into the lateral side walls 20, the side walls 20, 21 are set up correspondingly. A corresponding soldering of the edges of the side walls 20 and 21 to one another is not required because the connecting sleeve 15 has a sufficient stability even without a soldering.

The connecting sleeve 15 inserted into the opening of the water box 2 and is soldered to the wall of the water box 2. This can be carried out in a simple manner in one operation together with the soldering of the water box 2 to the finned tube block. Naturally, the connecting sleeve 15 may also at a later time be soldered into the already finished heater 1.

In the case of the embodiment shown, the exterior wall of the water box 2 is solder-plated so that, after the insertion of the connecting sleeve 15, during the heating to the soldering temperature, a soldered connection occurs directly in the connecting area of the connecting sleeve 15.

The tube connection 9 of the lower water box 3 is relatively poorly accessible. In order to simplify the connecting of the tube 13, only one end of an elbow 12 is soldered into the opening of the water box 3 in the area of the tube connection 9, at the other end of the elbow 12 the tube connection 14 comprising the connecting sleeve 15*a* being provided. This tube connection 14 is situated laterally next to the heater 1 and is therefore relatively easily accessible.

Figure 4:
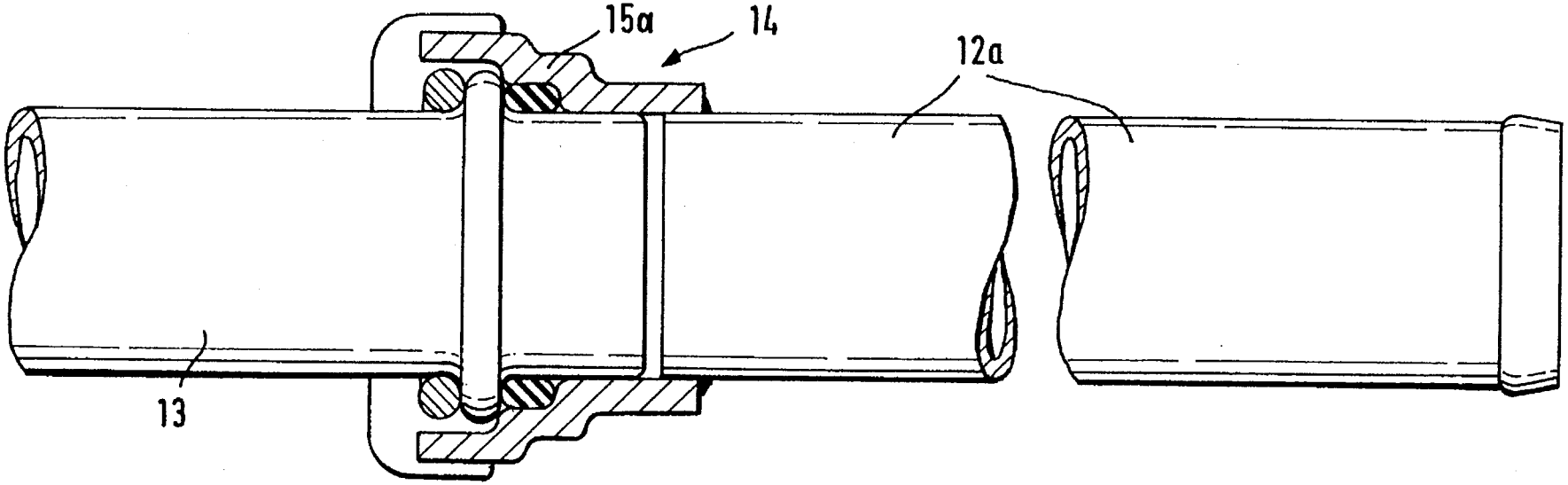
FIG. 4 is an enlarged view of an insert of the connecting sleeve according to FIGS. 2 and 3 for the connection of two tubes.

The tube connection is constructed corresponding to the representation according to FIG. 4 so that in the following reference is made to FIG. 4. The connecting sleeve 15*a* of the tube connection 14 is identical to the connecting sleeve 15 according to FIGS. 2 and 3 which was described in detail. The tight inserting of the tube 13 into the connecting sleeve 15*a* is also identical with the tight inserting of the described embodiment.

However, in contrast, the end of the connecting area of the connecting sleeve 15*a* is fitted onto the exterior side of the tube end of the tube 12*a* and is soldered to their exterior side. This soldered connection corresponds to the connection of the connecting sleeve 15*a* with the elbow 12 so that, to this extent, no further explanation will be necessary.

The inside diameter of the connecting area of the connecting sleeve 15*a* corresponds to the outside diameter of the tube end of the tube 12*a* so that, in the case of a soldering of the connecting area with the tube end, a surrounding tight connection is formed between the connecting sleeve 15*a* and the tube end of the tube 12*a*.

Figure 5:
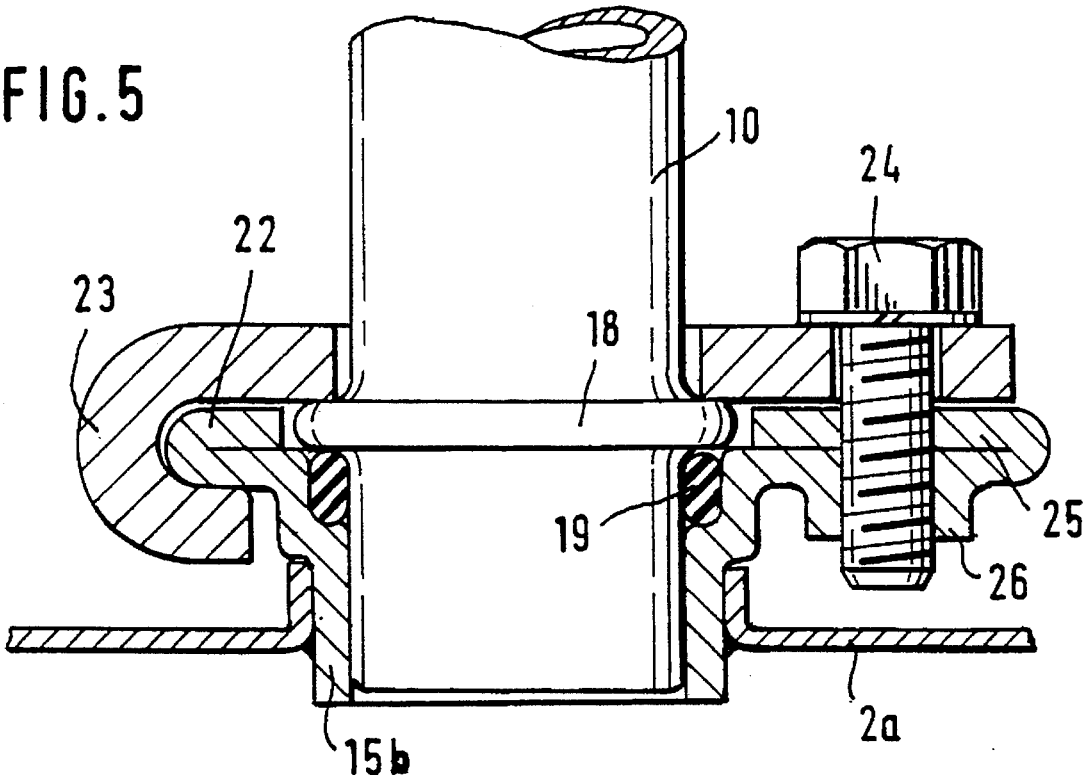
Figure 6:
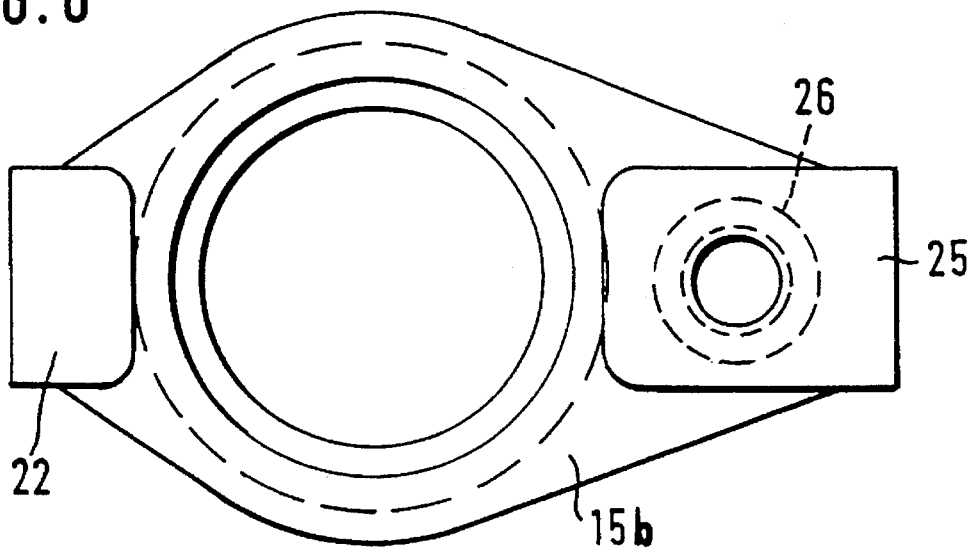
FIG. 6 is a top view of the connecting sleeve according to FIG. 5, the inserted tube end as well as the clamping lug to be screwed on not being shown.

The tube connection according to FIGS. 5 and 6 is slightly changed in comparison to the above-described embodiments. Also in the case of this embodiment, the connecting sleeve 15*b* has a tube-shaped connecting area and an adjoining stop collar device, in which case the connecting sleeve 15*b* is inserted by means of its connecting area, into an opening of a wall of a water box 2*a*. The opening is bounded by an outwardly projecting surrounding edge. In this case also, the connecting sleeve 15*b* in its connecting area is tightly soldered to the edge of the opening of the water box 2*a*.

However, in the case of this embodiment, the collar 18 of the tube end of the tube 10 inserted into the connecting sleeve 15*b* is not held tightly in the connecting sleeve 15*b* by means of a plug-type clamp but by a lug 23 which is secured by means of a screwed connection. The outwardly projecting edge of the connecting sleeve 15*b* is crimped over on two opposite sides for the purpose of increasing the stability, creating a suspension edge 22 and a receiving area 25 for a screw 24. At the suspension edge 22 of the connecting sleeve 15*b*, a portion, which is bent in the shape of a hook, of a securing lug 23 is suspended which consists of sheet metal and which reaches behind the collar 18, similarly to the above-described securing clamp. On the opposite side, the securing lug 23 is provided with a bore through which the screw 24 can be pushed. In order to permit the screwing-in of the screw 24 into the receiving area 25, this receiving area 25 has an extruded hole 26. Therefore, as soon as the screw 24 has been screwed into the receiving area 25, it clamps the securing flange 23, whereby the collar 18 is pressed tightly into the connecting sleeve 15*b*.

An embodiment of the invention, which is not shown, corresponds essentially to the representation according to FIG. 5 and 6. In the case of this embodiment, the lower edge of the connecting area of the connecting sleeve, in addition, is provided with a radially inwardly projecting notch with which a corresponding notch on the lower edge of the shell surface is caused to engage when the tube is inserted. As a result, it is ensured that the tube can be inserted into the connecting sleeve only in a certain position.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A method of making a water box and tube connection assembly for a motor vehicle heat exchanger, comprising:

forming a water box of metallic material using a deep drawing forming operation with formation of an inwardly bent axially extending surrounding edge around a connection sleeve opening with solder plating of said surrounding edge, forming a connecting sleeve of metallic material in a deep drawing operation with solder plating of the connecting sleeve along an axially extending connection area of the connecting sleeve, axially inserting the connecting sleeve into the connection sleeve opening of the water box with the connection area extending along and adjacent to the inwardly bent surrounding edge, and heating the water box and sleeve with resultant formation of a soldered connection between the connection sleeve and the inwardly bent surrounding edge of the water box connection sleeve opening.

2. A method according to claim 1, wherein said forming a connecting sleeve includes forming a step-shaped stop collar on said connection sleeve adjacent said connection area, said stop collar having a larger cross-sectional dimension than said connection area, and wherein said inserting the connecting sleeve into the connection sleeve opening includes use of the stop collar to position the connecting sleeve in the connection sleeve opening of the water box.

3. A method according to claim 2, wherein the metallic material of the water box is the same as the metallic material of the connecting sleeve.

4. A method according to claim 3, wherein said metallic material is aluminum.

5. A method according to claim 1, wherein the metallic material of the water box is the same as the metallic material of the connecting sleeve.

6. A method according to claim 5, wherein said metallic material is aluminum.

7. A method according to claim 1, wherein the soldering of the connecting sleeve to a wall of the water box is done simultaneously with soldering of the water box to a fin tube block.

8. A water box and tube connection assembly for a motor vehicle heat exchanger, comprising:

a water box of metallic material formed by a deep drawing forming operation with formation of an inwardly bent axially extending surrounding edge around a connection sleeve opening with solder plating of said surrounding edge, and a connecting sleeve of metallic material formed in a deep drawing operation with solder plating of the connecting sleeve along an axially extending connection area of the connecting sleeve, wherein the connecting sleeve is axially inserted into the connection sleeve opening of the water box with the connection area extending along and adjacent to the inwardly bent surrounding edge, a solder connection being formed by the solder plating along the connection area and surrounding edge.

9. An assembly according to claim 8, wherein said connecting sleeve includes a step-shaped stop collar adjacent said connection area which has a larger cross sectional dimension than the connection area, said stop collar limiting the axial insertion position of the connecting sleeve into the connection sleeve opening.

10. A method according to claim 9, wherein the metallic material of the water box is the same as the metallic material of the connecting sleeve.

11. A method according to claim 10, wherein said metallic material is aluminum.

12. An assembly according to claim 8, wherein the metallic material of the water box is the same as the metallic material of the connecting sleeve.

13. A method according to claim 12, wherein said metallic material is aluminum.

14. An assembly according to claim 8, wherein the soldering of the connecting sleeve to a wall of the water box is done simultaneously with soldering of the water box to a fin tube block.

* * * * *